US007713061B1

(12) United States Patent
Albertini

(10) Patent No.: US 7,713,061 B1
(45) Date of Patent: May 11, 2010

(54) GOLF SWING TRAINING SYSTEM

(76) Inventor: Eugene J. Albertini, 3355 Via Lido, Suite 360, Newport Beach, CA (US) 92663

( * ) Notice: Subject to any disclaimer, the term of this patent is extended or adjusted under 35 U.S.C. 154(b) by 1309 days.

(21) Appl. No.: 10/738,948

(22) Filed: Dec. 16, 2003

(51) Int. Cl.
*A63F 9/24* (2006.01)
*A63F 13/00* (2006.01)
*G06F 17/00* (2006.01)
*G06F 19/00* (2006.01)

(52) U.S. Cl. ..... 434/252; 283/115; 473/218; 473/220; 473/409

(58) Field of Classification Search ..... 473/131, 473/218–220, 223, 226, 237, 240, 257, 278, 473/407, 409; 434/252
See application file for complete search history.

(56) References Cited

U.S. PATENT DOCUMENTS

| | | | | | |
|---|---|---|---|---|---|
| 2,080,608 | A | * | 5/1937 | Hannaford | 473/220 |
| 2,223,849 | A | * | 12/1940 | Fogler et al. | 283/115 |
| 3,070,373 | A | * | 12/1962 | Mathews et al. | 473/220 |
| 3,106,403 | A | * | 10/1963 | Kirkman | 473/220 |
| 3,953,034 | A | | 4/1976 | Nelson | 273/186 C |
| 5,207,429 | A | | 5/1993 | Walmsley et al. | 273/186.2 |
| 5,288,080 | A | | 2/1994 | Tice | 273/186.3 |
| 5,467,991 | A | | 11/1995 | White, IV et al. | 273/186.3 |
| 5,788,582 | A | * | 8/1998 | Shapiro | 473/220 |
| 5,788,588 | A | * | 8/1998 | Hooker | 473/409 |
| 5,897,441 | A | * | 4/1999 | Apthorp | 473/220 |
| 5,954,592 | A | | 9/1999 | Laffer et al. | 473/220 |
| 5,980,393 | A | * | 11/1999 | Molinaroli et al. | 473/220 |
| 6,059,668 | A | * | 5/2000 | Marley, Jr. | 473/220 |
| 6,149,531 | A | | 11/2000 | Hooker | 473/220 |
| 6,149,537 | A | | 11/2000 | Hooker | 473/409 |
| 6,386,988 | B1 | | 5/2002 | Shearer et al. | 473/220 |
| 6,468,167 | B1 | | 10/2002 | Florian | 473/278 |
| 6,743,111 | B2 | * | 6/2004 | Mindlin | 473/218 |
| 6,796,910 | B1 | * | 9/2004 | Foster | 473/220 |
| 7,134,966 | B1 | * | 11/2006 | Tice | 473/220 |

FOREIGN PATENT DOCUMENTS

GB 2267834 A * 12/1993

* cited by examiner

*Primary Examiner*—John M. Hotaling, II
*Assistant Examiner*—Paul A. D'Agostino
(74) *Attorney, Agent, or Firm*—Russo & Duckworth, LLP; David G. Duckworth

(57) ABSTRACT

An improved golf club swing training system is provided for assisting golfers to improve their golf swing. The golf swing training system includes a golf club including a traditional shaft, head and head face. Moreover, the training system includes a light source for producing a plane of light. Preferably, the light source uses a laser for producing the plane of light which forms a light line when striking the ground or other flat surface. In addition, the swing training system includes a practice mat. The practice mat includes a plurality of substantially straight mat lines which are positioned and aligned to identify proper golf swing position at various points through a golfer's swing. The golf swing training system includes the golfer repetitively practicing his golf swing so that the light source produces a light line which aligns with the mat lines so as to reinforce proper golf swing position.

2 Claims, 13 Drawing Sheets

GOLF SWING TRAINING SYSTEM

BACKGROUND OF THE INVENTION

The present invention relates to practice aids and systems for assisting persons to improve their swings. More particularly, the present invention relates to practice aids for teaching persons proper alignment when swinging a sporting club or the like. There are many examples of practice aids which are used to hit an object towards a target including the baseball bat, tennis racquet, squash racquet, ping pong paddle, croquet club, etc. However, the training system of the present invention is believed to have particular application to assisting persons in improving their golf swing. The invention is not intended to be limited to golf swing training. Accordingly, the invention is described with particularity for golfing applications.

Golf clubs include a shaft and club head which are used to hit a stationary ball towards a golf course green. The golf club's shaft has a proximal extremity and a distal extremity, and the club head is mounted to the shaft's distal extremity. In most circumstances, the club head is substantially planar and transverse to the target line which extends towards a target.

A successful strike of a golf ball is dependant upon the alignment or orientation of the club head impact surface at the point of contact with the ball. If the impact surface is not perfectly transverse to the target line, then the ball will not travel in an intended direction. During a golf club back swing, it is necessary to rotate your forearms in a clockwise direction (for a right-handed person), and then rotate your forearms in a counterclockwise direction during the forward swing such that the club head arrives at a square position at the point of impact. Such movement of the club head during the back swing, forward swing and follow through, is extremely difficult to achieve. Furthermore, the fact that the club head is traveling at a great velocity makes it extremely difficult to gauge the position of the club head during the swing.

In the past, a great number of devices have been proposed which attempt to indicate the orientation of the club head during a golf swing. Many such devices include the use of a light source that directs a beam of light for representing golf club orientation and golf club swing path. For example, U.S. Pat. Nos. 6,149,537 and 6,149,531 describe golf putters which include a laser contraption. A laser diode or the like transmits a beam downwardly from the handle of the club to project a beam of light near the golfer's feet. Swinging the club causes the beam to define and illustrate the golfer's swing path. Optionally, the contraption includes an additional glass rod positioned in front of the laser to project a path of light.

Alternatively, U.S. Pat. No. 3,953,034 describes an apparatus which includes a laser device and a mirror which projects a fan shaped beam along the ground ahead of a club face.

The device is intended to enable a user to see the line of light on the ground as the ball is hit so that the golfer can determine whether the ball is being hit straight, with a hook, or with a slice. U.S. Pat. No. 5,467,991 discloses a device for attachment to an actual golf club. The device transmits a light beam which traces a straight line behind the ball during the back swing and an oppositely directed light beam picks up the same line when the golf club is properly swung as the club approaches the top of the back swing. Additionally, U.S. Pat. No. 5,288,080 describes a golf club which has been modified to include strobing lights which are emitted from the club head's top surface. These strobing lights provide a path of light illustrating the club's angle and path during the golfer's swing. Still an additional golf aid is described in U.S. Pat. No. 5,207,429. This reference describes a laser apparatus which attaches and detaches to a traditional golf putter. A prism is provided so as to project the laser into a path of light as opposed to a mere beam of light. Pending U.S. patent application Ser. No. 10/383,481 also describes a golf club including a laser. Using a rotating mirror, the laser produces a plane of light indicating both golf club position and rotation. U.S. patent application Ser. No. 10/383,481 is incorporated in its entirety by reference herein.

In addition, specially constructed mats have been developed for use in developing and correcting a person's golf swing. For example, U.S. Pat. No. 5,954,592 describes a mat including a plurality of arcuate lines for assisting a person to train their golf swing. A golf club is provided which includes a laser device on the club's proximal extremity for producing a laser beam of light that traverses the mat. By swinging the club so that the laser beam follows the arcuate lines, golfers are taught how to swing the club along a preferred swing path. Somewhat similarly, U.S. Pat. No. 6,386,988 describes a shoulder mounted device including two lasers. The lasers are positioned so as to shine beams of light upon the arcuate path shown on a floor mat. By rotating the shoulders so as to repetitively follow the arcuate path on the mat, golfers are taught how to swing the club along a preferred swing path. Meanwhile, U.S. Pat. No. 6,468,167 describes a golf training system including a mat and golf club with mounted laser. The mat includes two dots supposedly indicating proper club position when the golf club laser strikes the dots.

Unfortunately, though some of the prior swing training systems help identify proper club position or rotation, none of the golf training systems provide for training and correcting a person's swing by identifying proper swing path and proper club position and club rotation through the golf swing.

It is therefore an object of the invention to overcome the above-described disadvantages by providing a swing training system which is inexpensive to manufacture and which can be used in cooperation with a standard sporting club.

It is still an additional object of the invention to provide a golf swing training system which provides an indication of club head orientation and path throughout a golfer's entire back swing, forward swing and follow-through.

SUMMARY OF THE INVENTION

Briefly, in accordance with the invention, I provide a swing aid system for a sporting club having a shaft. More particularly, I provide a swing aid system for assisting a person to correct or improve their swing of a sporting club including such clubs as a golf club, baseball bat, tennis racquet, squash racquet, ping pong paddle, croquet club, etc. However, the system is believed to have particular application to assisting persons in improving their golf swing, and accordingly, the invention is described with particularity for golfing applications.

The golf swing training system includes a practice golf club including a light source for producing a plane of light. Construction for producing a plane of light emitted from a golf club can be determined by those skilled in the art without undue experimentation. Accordingly, the light source construction is not described with particularity herein. However, preferred light sources include the laser device described in U.S. patent application Ser. No. 10/383,481, and to a lesser extent the laser device described in U.S. Pat. No. 5,207,429, which are incorporated by reference herein.

For practicing the present invention, the light source is preferably affixed to the golf club shaft so as to produce a plane of light which is substantially parallel to the golf club's face. Thus, when the golfer holds the club in the traditional "ready" or "address" position, the light source produces a plane of light that projects substantially longitudinal with respect to the golfer's body. Moreover, the plane of light striking the ground produces a line of light extending longitudinally with respect to the golfer's body. As the golfer swings the practice golf club, the plane of light moves and rotates, causing the line of light produced on the ground to move and rotate. The position and rotation of the light upon the ground provides an indication of proper or improper swing position throughout the golf swing.

The golf swing training system further includes a practice mat for being positioned on the ground. The practice mat includes a plurality of substantially straight mat lines positioned and aligned to identify proper golf swing positions at various points through a golfer's swing. The mat may be pre-printed with the mat lines to represent the swing of the "average" or "expert" golfer. However, preferably the mat lines are added by each individual user to provide a unique mat line template for use only be a single golfer. Virtually any number of mat lines may be provided. For example, the mat may include only two lines, including a first mat line indicating position and alignment of a golfer's back swing and a second mat line indicating position and alignment of the golfer's follow-through. However, in a preferred embodiment, the mat includes eleven (11) mat lines including five lines indicating swing positions from a golfer's "address" position through the golfer's full coil back swing, and six additional lines indicating swing positions from a golfer's back swing through full follow-through.

To practice the golf system of the present invention, the golfer slowly swings the practice golf club from the address position, though his back swing and follow-through. As the light line strikes and aligns with a mat line, the golfer pauses his swing for several seconds so that his muscles develop "muscle memory" so that the golfer's body remembers the correct swing position through various points in the golfer's swing. Through repetition of the practice swing, the golfer develops an improved golf swing for use on a golf course.

It is thus an object of the present invention to provide an inexpensive system for assisting persons in perfecting their sporting club swing.

It is still an additional object of the present invention to provide a system which can be used to modify traditionally constructed sporting clubs.

It is still an additional object of the invention to provide a club swing aiding system which provides persons with an indication of their club swing and club orientation during club back stroke, forward stroke and follow-through.

These and other and more specific objects and advantages of the invention will be apparent to those skilled in the art from the following detailed description taken in conjunction with the drawings.

DETAILED DESCRIPTION OF THE INVENTION

Figure 1:
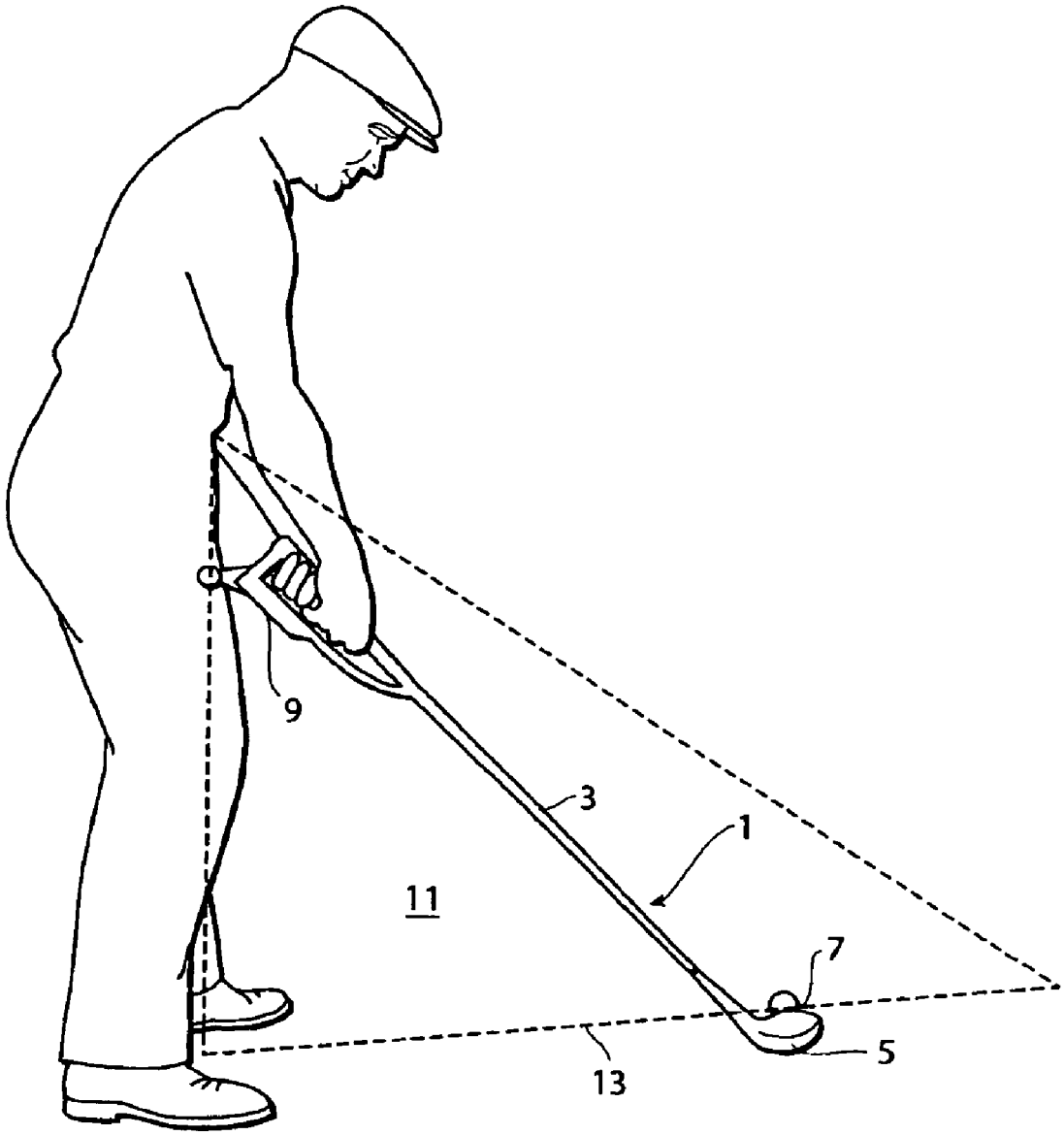
FIG. 1 is a perspective view illustrating an individual using the golf swing training system of the present invention.

While the present invention is susceptible of embodiment in various forms, as shown in the drawings, hereinafter will be described the presently preferred embodiments of the invention with the understanding that the present disclosure is to be considered as an exemplification of the invention, and it is not intended to limit the invention to the specific embodiments illustrated. For example, the swing training system is described with particular application to training a golfer to improve his golf swing. However, the invention is believed to have application for assisting persons in improving their swings of other objects. Thus, the present invention is not intended to be limited to swing training systems for training golfers only.

With reference to FIG. 1, the swing training system of the present invention is particularly adaptable for use in training a golfer. The golf swing training system of the present invention includes a golf club 1 including a shaft 3 and head 5. The golf club head 5, in turn, includes a substantially vertical planar face 7 for use in striking a golf ball. Preferably, the golf club is weighted and includes a 360 cc, overall weight 30 oz., head for men, and a 250 cc, overall weight 26 oz., head for ladies and juniors. The golf club grip may be sized for the average man or woman, or the grip may be sized for a particular person. The grip may be used with either a Vardon overlapping grip, or an interlocking grip, such as used by Jack Nicklaus or Tiger Woods.

The golf swing training system further includes a light source 9 mounted to the golf club 1 for emitting a plane of light 11. Though the plane of light may be oriented at various angles relative to the golf club shaft, such as to be produced perpendicular to the golf club face 7, as shown in the figures preferably the plane of light 11 is positioned and oriented to be parallel to the golf club face so that when the golfer is in the "address" position, the light source produces a plane of light 11 and is aligned in the same direction as the golfer is facing. Upon striking the ground, the light plane 11 forms a light line 13 which provides an indication of the golf club's position and rotational orientation.

The golf swing training system further includes a practice mat 15 which is placed on the ground. The practice mat includes a plurality of straight mat lines 17. Moreover, the practice mat 15 may include one or more foot lines 19 for identifying the proper placement and orientation of a golfer's feet upon the mat.

The practice mat may be pre-printed with the mat lines and feet lines. Alternatively, the mat lines and feet lines may be added using marking utensils such as pens or markers, or by using colored tape applied in place upon the practice mat.

Any number of mat lines and foot lines may be provided. However, in a preferred embodiment, the practice mat is provided with pre-printed foot lines as shown in FIGS. 2-12, but the mat lines are added by a golfer to reflect the golfer's unique swing. In a preferred embodiment, a golfer adds eleven mat lines to the practice mat for training the golfer's swing. For example, using the golf club 1, practice mat 15, a yardstick or the like, and marking materials, the practice mat is uniquely developed by adding a mat line to various swing positions reflecting specific body alignment positions of a particular golfer. Addition of the preferred eleven mat lines is explained as follows.

First Mat Line

Figure 2:
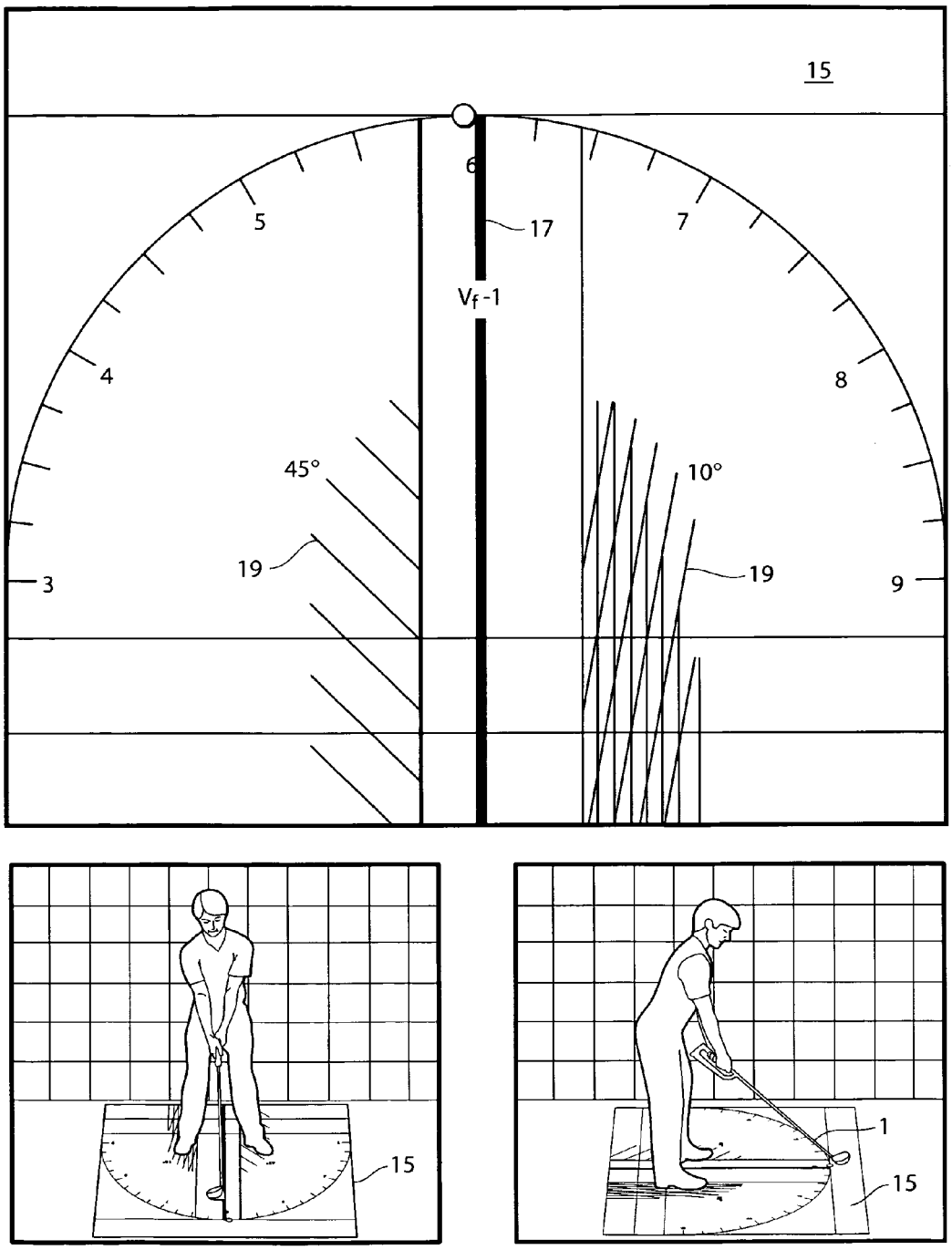
FIG. 2 is a top view showing a mat of the present invention including a first mat line, as well as two smaller front and left side views illustrating an individual using the golf swing training system of the present invention with the individual's golf swing in a first position.

With reference to FIG. 2, preferably the mat has a half circular line representing the center of an angled clock wherein the golfer faces the "6:00" position which corresponds to the golf ball in front of the golfer. The golfer then follows the following steps to mark the practice mat.

- The golfer stands with the back of his heels parallel to one another.
- The golfer pivots his left foot counterclockwise approximately 30°-50° in substantially parallel manner to the feet lines 19.
- The golfer pivots his right foot clockwise approximately 10° to be in substantially parallel manner to the feet lines 19.
- The golfer bends from the hip joints and hangs his arms such that the angle of spine is bent from the hip joints in a manner comfortable to the golfer.
- The golfer bends his knees slightly in traditional golfing manner. The golfer positions his club head in front of his body to the "address position" such that the light source produces a light line 13 which is directly aligned with the toe/sole of his club, and approximately 2" behind the golfer's left heel.
- Using a yardstick or other similar straight construction, and marking materials, the golfer draws a red line coincident with the light line 13 to form the first mat line 17.

Second Mat Line

Figure 3:
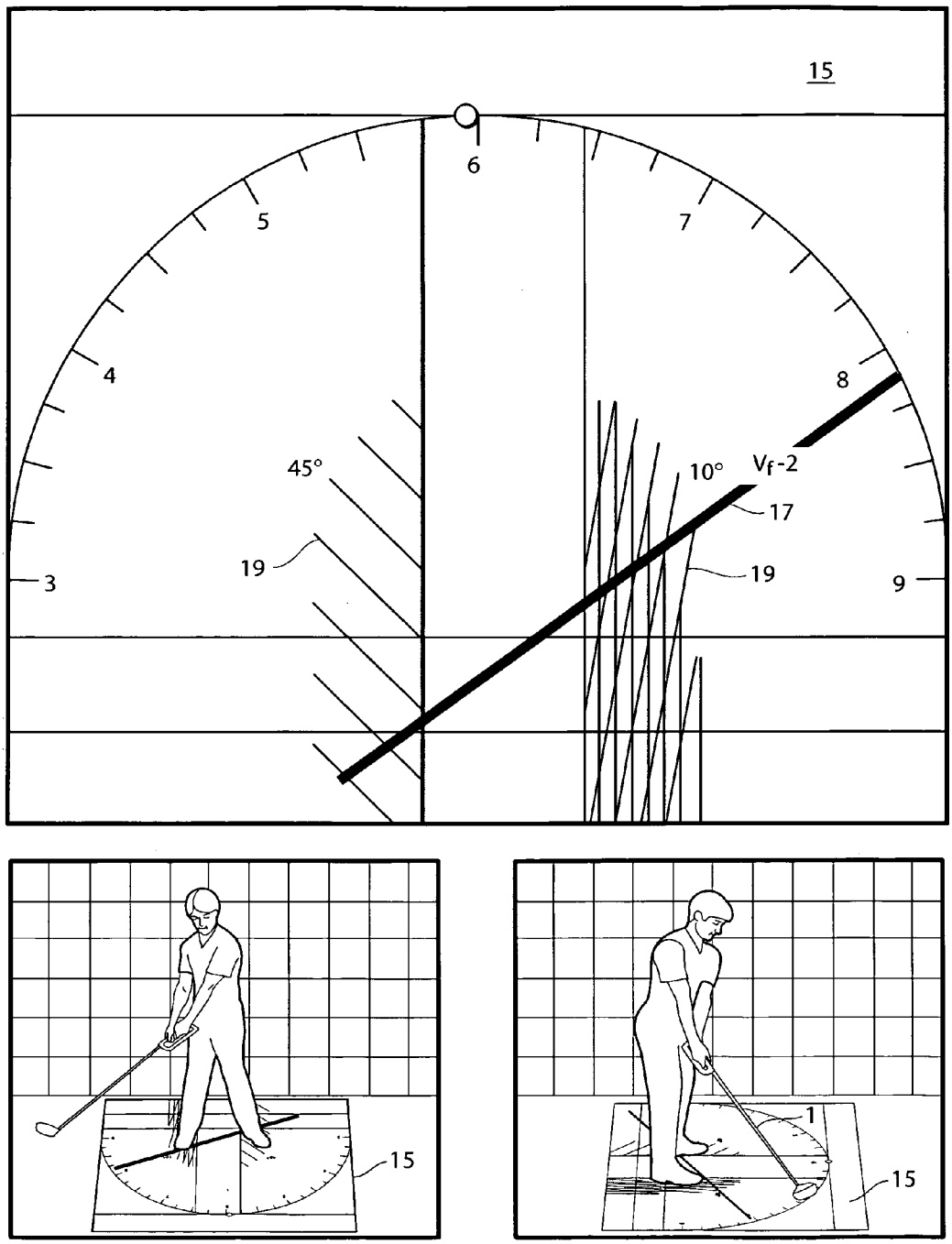
FIG. 3 is a top view showing a mat of the present invention including a second mat line, as well as two smaller front and left side views illustrating an individual using the golf swing training system of the present invention with the individual's golf swing in a second position.

With reference to FIG. 3, to form the second mat line, the golfer performs the following steps.

- The golfer moves his hands, arms and body in unison in the initial stages of a golf back swing until the light line 13 is approximately at an 8:15 position on the practice mat.
- The golfer adjusts his swing such that the light line 13 runs approximately from inside the toe of his right foot to touching the heel of his left foot.
- Again using a yardstick and marking materials, the golfer adds a line upon the practice mat atop the placement of the light line 13 to create the second mat line 17.

Third Mat Line

Figure 4:
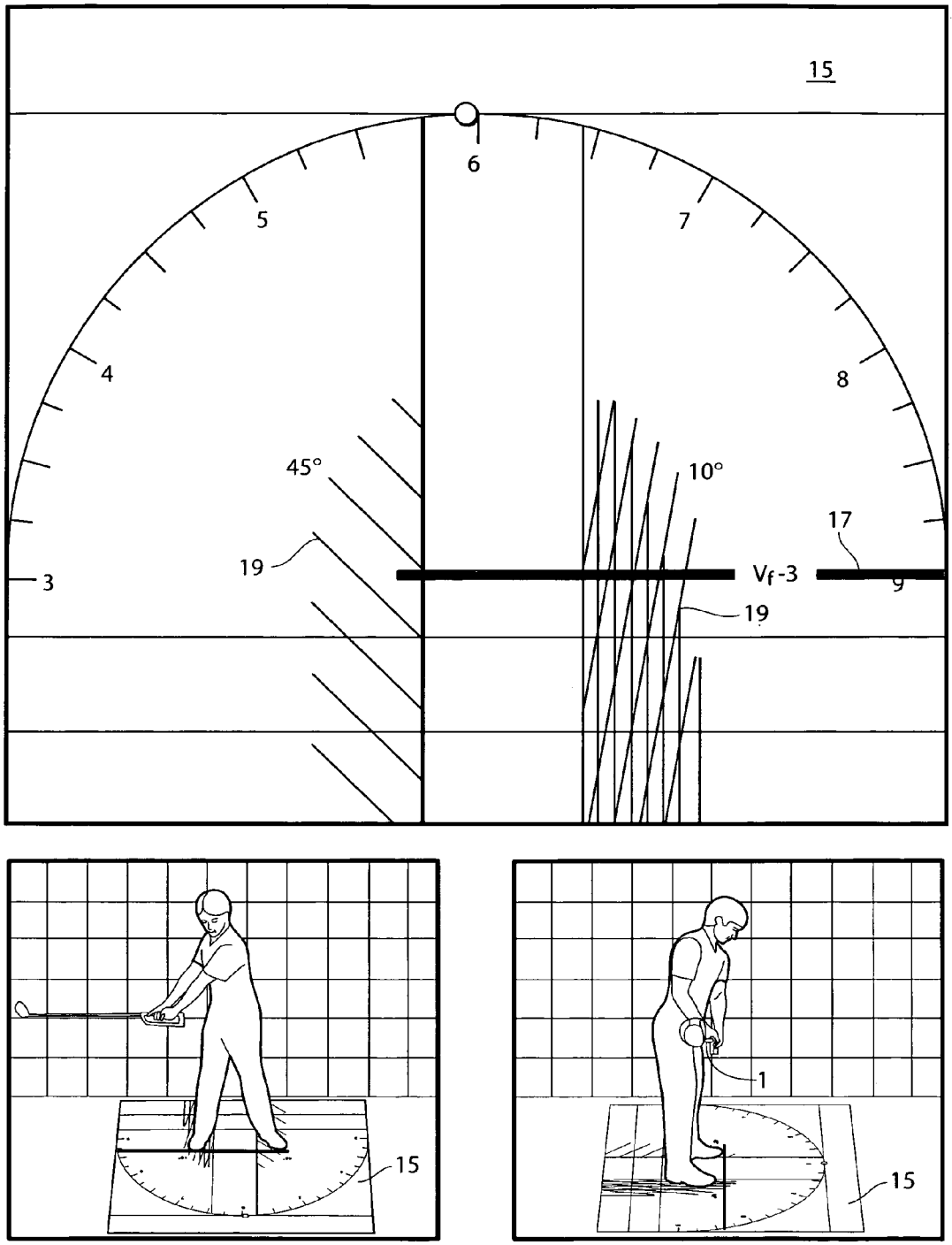
FIG. 4 is a top view showing a mat of the present invention including a third mat line, as well as two smaller front and left side views illustrating an individual using the golf swing training system of the present invention with the individual's golf swing in a third position.

With reference to FIG. 4, the third mat line 17 is formed by the golfer performing the following steps.

- The golfer pivots his body in golf swing manner around his right hip joint until the light line 13 is approximately at a 9:00 position. The light line 13 should be approximately parallel and facing the golfer's feet.
- The golfer adds a mat line 17 to the mat by using the yardstick and marking materials where the light line 13 resides.

Fourth Mat Line

Figure 5:
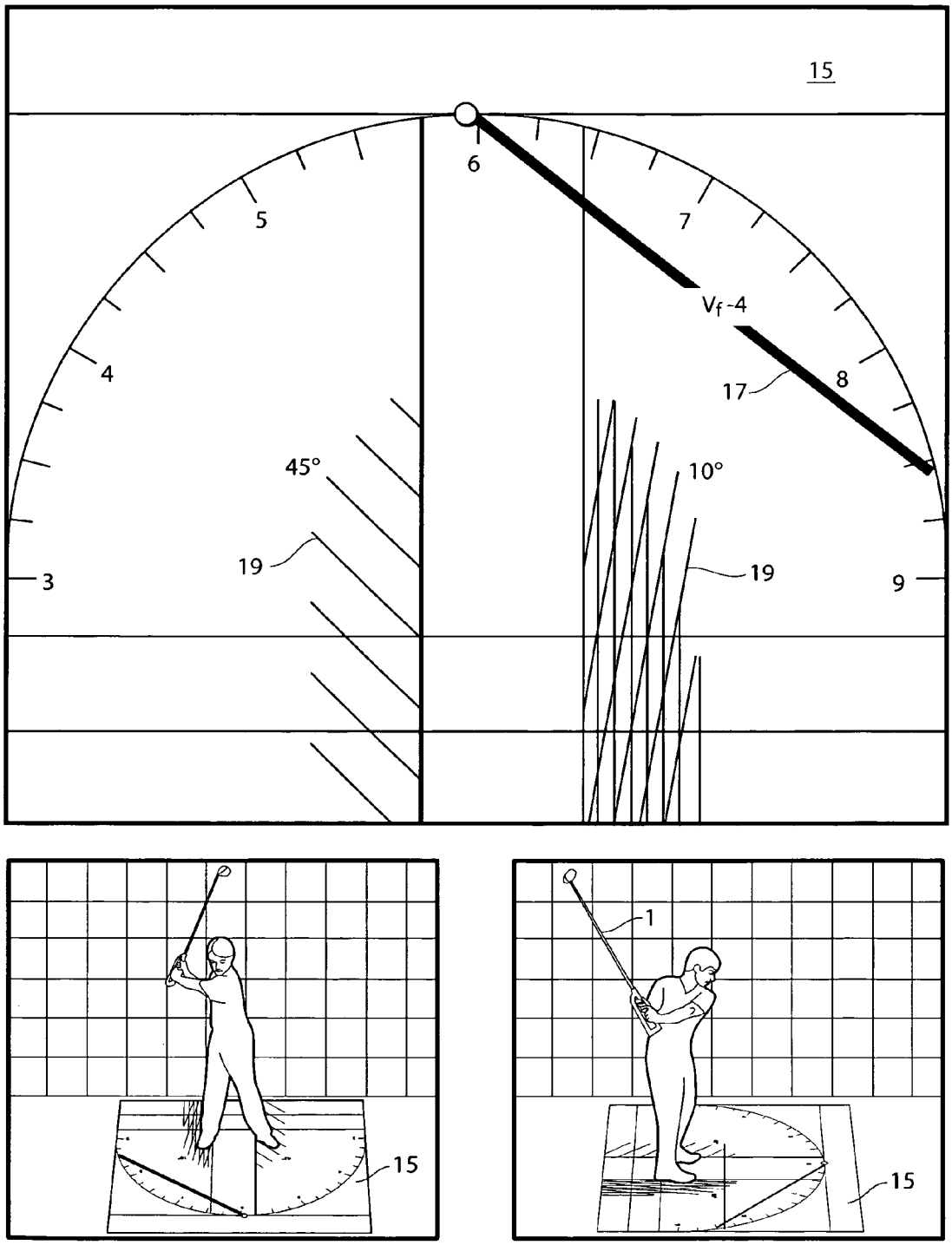
FIG. 5 is a top view showing a mat of the present invention including a fourth mat line, as well as two smaller front and left side views illustrating an individual using the golf swing training system of the present invention with the individual's golf swing in a fourth position.

With reference to FIG. 5, the fourth mat line 17 is added in the following manner.

- The golfer pivots his left hip until his right leg is braced around the right hip joint to approximately 30° closed from the golfer's original position.
- The golfer moves his right arm slightly away from his body and moves his left arm across his chest with his shoulders having pivoted approximately 75°.
- The golfer moves both arms up to shoulder height and simultaneously rotates clockwise so that his arms are fully rotated, his wrists are fully hinged, and his left arm is horizontal.
- The laser light passes through approximately 7:45 on the clock dial and the ball position formed on the practice mat 15.
- The golfer then applies a mat line 17 to the practice mat to indicate position of the light line.

Fifth Mat Line

Figure 6:
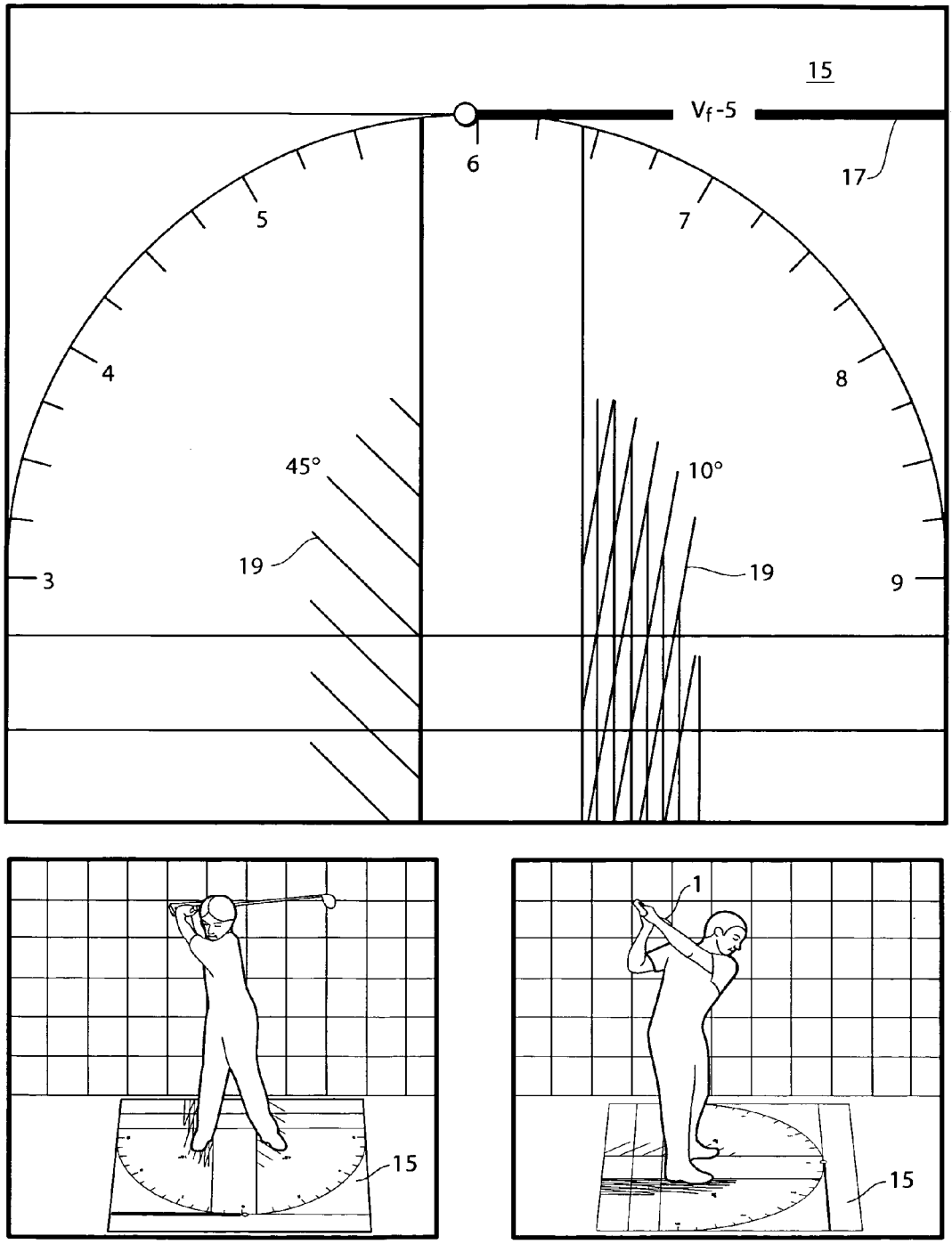
FIG. 6 is a top view showing a mat of the present invention including a fifth mat line, as well as two smaller front and left side views illustrating an individual using the golf swing training system of the present invention with the individual's golf swing in a fifth position.

With reference to FIG. 6, the golfer adds the fifth mat line by performing the following steps.

- The golfer completes his back swing such that the shaft of the golf club 1 is substantially parallel to the ground after the body is fully coiled.
- The golfer pivots his left hip into the right hip joint by slightly raising his left heel.
- The laser line 13 on the practice mat 15 is substantially parallel to the golfer's body.
- The mat line 17 is applied to the light line 13 to form the fifth mat line.

Sixth Mat Line

Figure 7:
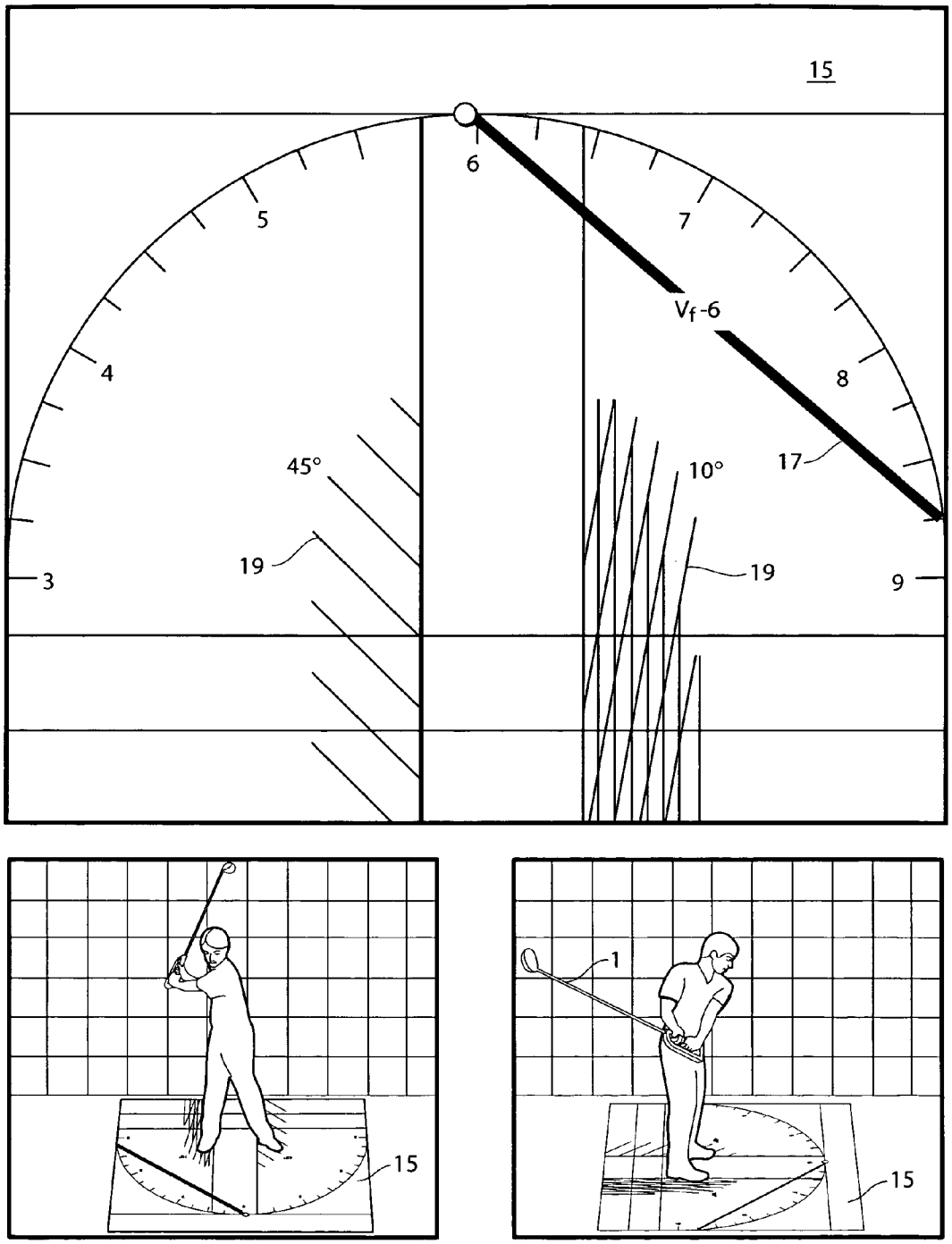
FIG. 7 is a top view showing a mat of the present invention including a sixth mat line, as well as two smaller front and left side views illustrating an individual using the golf swing training system of the present invention with the individual's golf swing in a sixth position.

With reference to FIG. 7, the golfer's back swing has been completely completed, and the golfer moves into his follow-through. To introduce the sixth mat line, the golfer performs the following steps.

The golfer brings his right bicep slightly against the outside of his right pectoral muscle, placing the laser line 13 approximately upon where a ball would reside and such that the light line passes through 8:45 on the clock dial.

The golfer initiates the down swing with his hips and left leg by transferring weight from the right foot to the inside muscles of the left leg.

The golfer's wrists remain set with the golfer's right wrist completely and fully hinged.

A light line 13 is added to the practice mat to form the sixth mat line.

Seventh Mat Line

Figure 8:
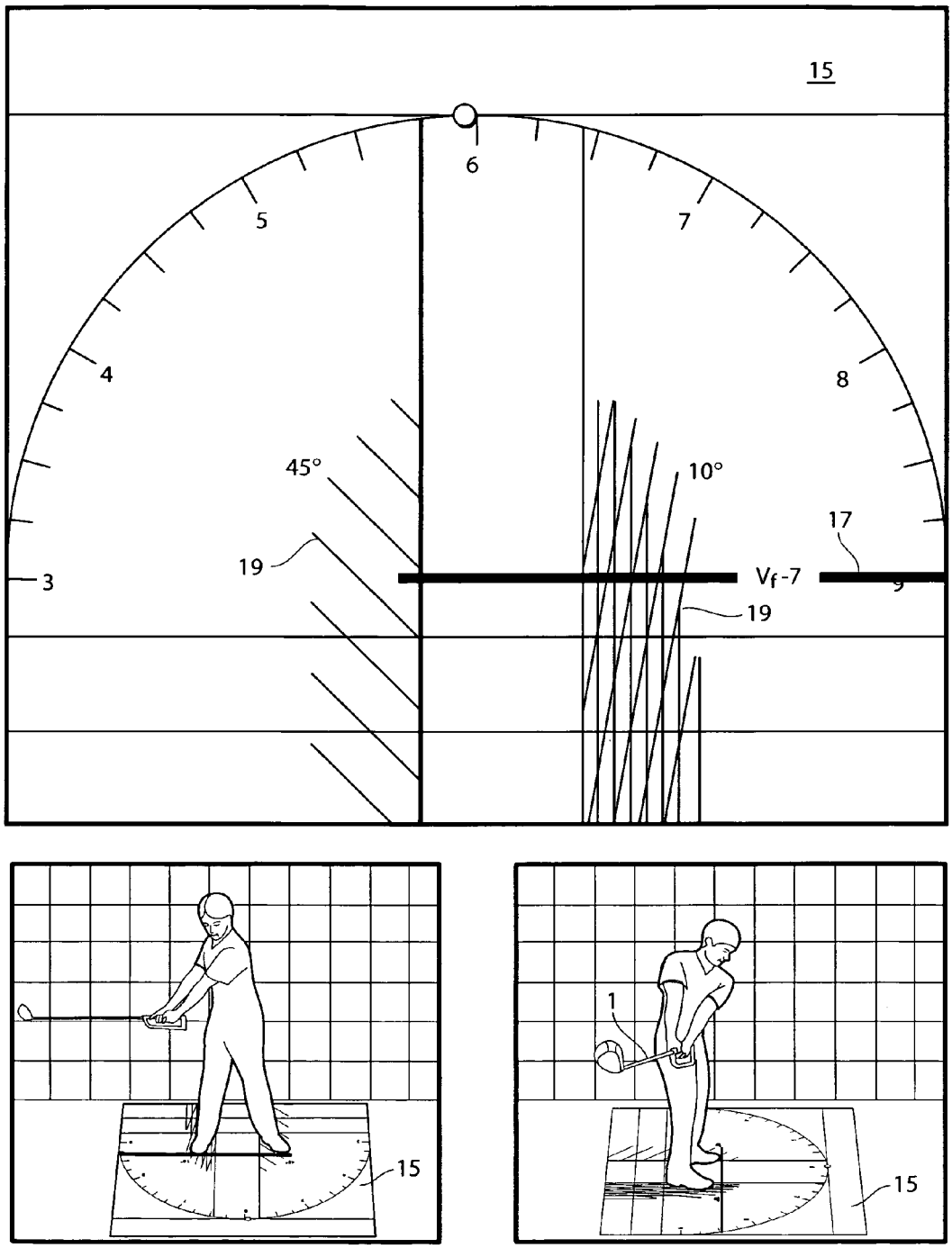
FIG. 8 is a top view showing a mat of the present invention including a seventh mat line, as well as two smaller front and left side views illustrating an individual using the golf swing training system of the present invention with the individual's golf swing in a seventh position.

With reference to FIG. 8, the seventh mat line is added as follows.

The golfer pivots his right hip into his left hip joint to the point that his body is "open" approximately 15° to the ball's line of flight.

A light line 13 is formed approximately 2" in front of the golfer's toes, parallel to the golfer's body.

The golfer adds a seventh mat line 17 to the practice mat to reflect the position of the light line using the marking materials.

Eighth Mat Line

Figure 9:
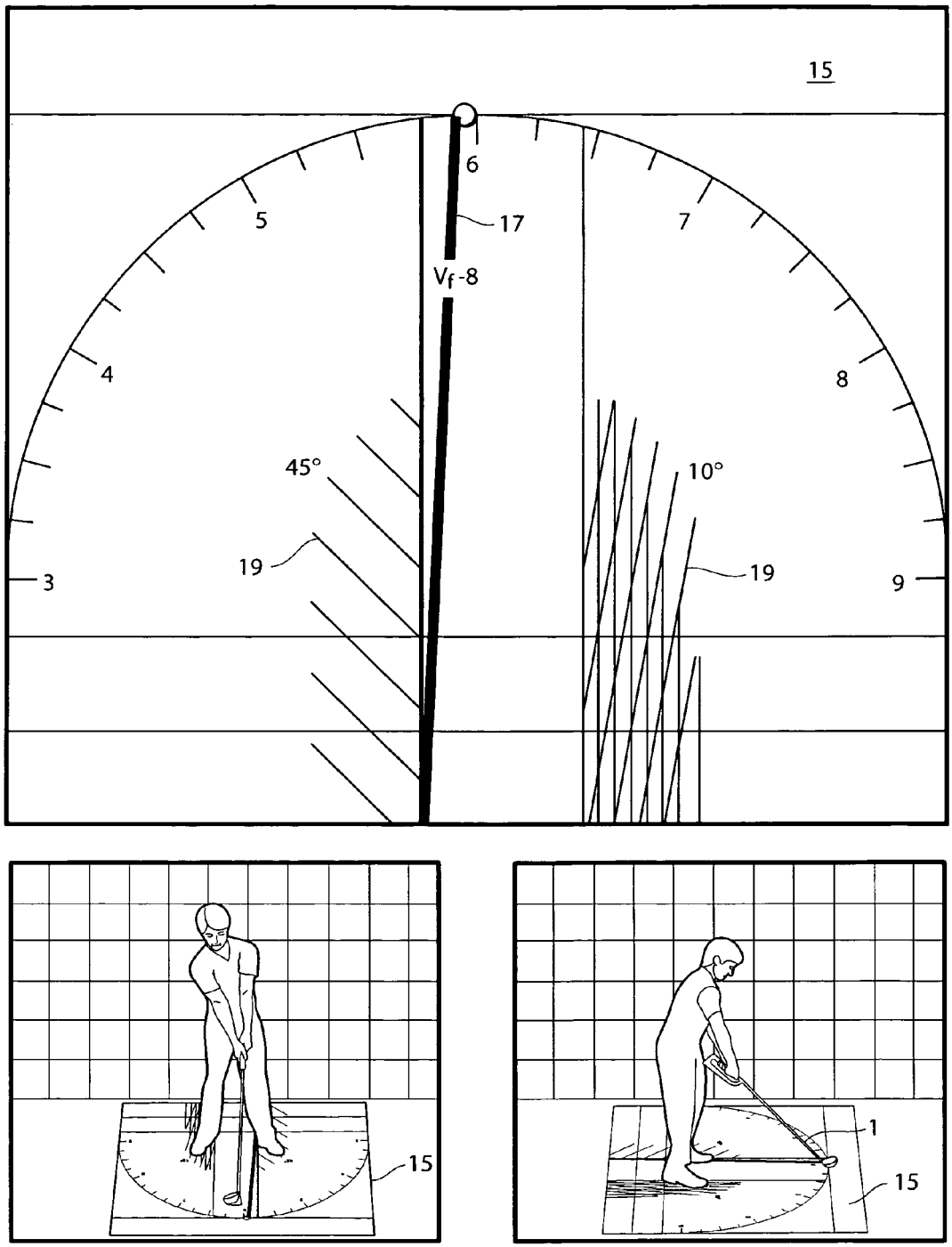
FIG. 9 is a top view showing a mat of the present invention including an eighth mat line, as well as two smaller front and left side views illustrating an individual using the golf swing training system of the present invention with the individual's golf swing in an eighth position.

With reference to FIG. 9, the eighth mat line identifies the golfer's position when striking the golf ball. To form the eighth mat line, the golfer performs the following steps.

The golfer swings the golf club 1 in traditional manner pivoting his left hip joint around the sternum until the club head strikes the ball.

A light line is formed approximately 5° from perpendicular to the golfer's body as shown.

A mat line 17 is then added to the practice mat 15 using the marking materials to reflect the placement of the light line 13.

Ninth Mat Line

Figure 10:
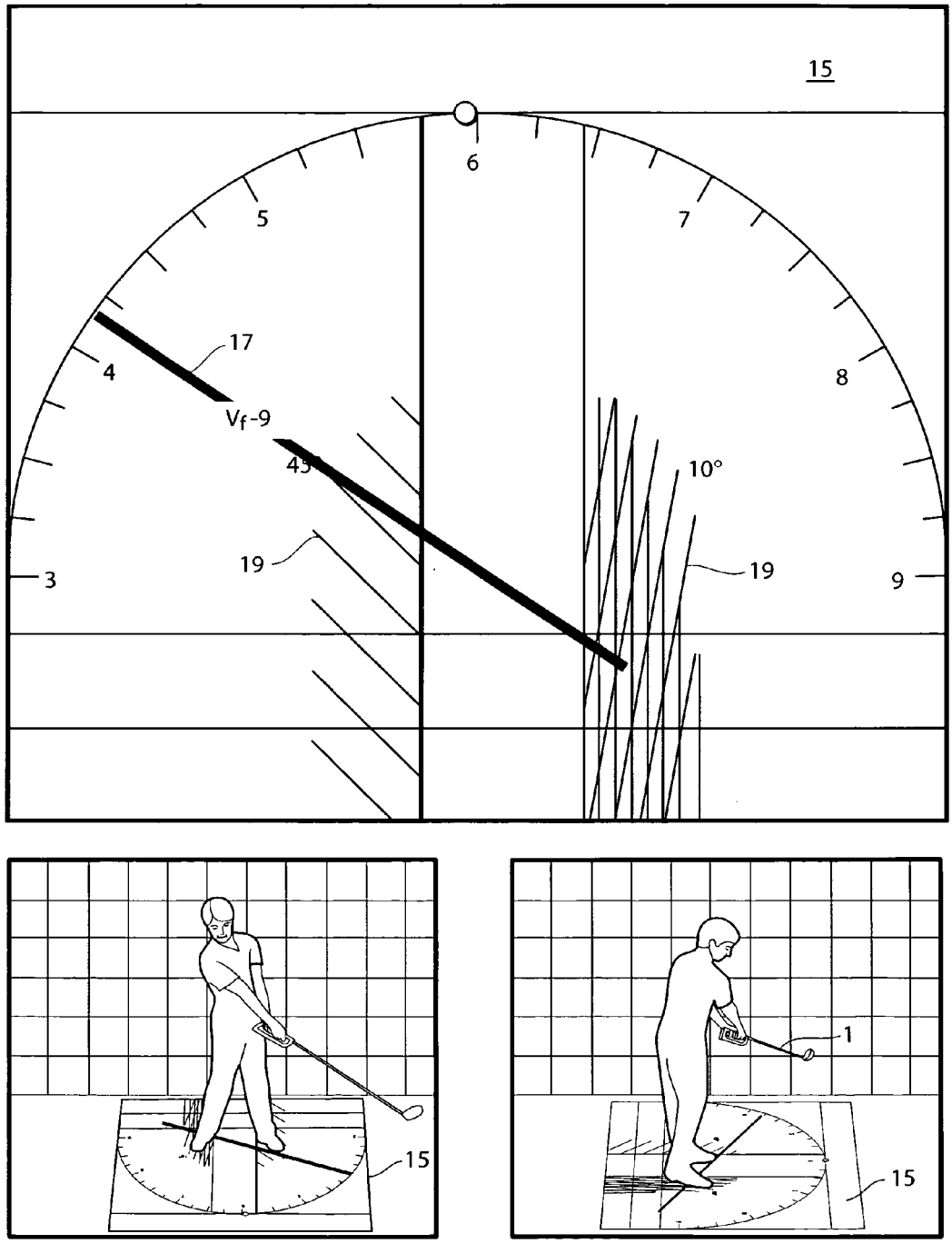
FIG. 10 is a top view showing a mat of the present invention including a ninth mat line, as well as two smaller front and left side views illustrating an individual using the golf swing training system of the present invention with the individual's golf swing in a ninth position.

With reference to FIG. 10, a ninth mat line 17 is added to the practice mat 15 in accordance with the following steps.

The golfer continues his follow-through until the light line is approximately to the 4:00 position. There will be a slight gap between the light line 13 and the golfer's left toe. Meanwhile, the light line will continue slightly back of the instep of the golfer's right foot.

Once the light line 13 is in place, using the marking materials, the light line's position is recorded.

Tenth Mat Line

Figure 11:
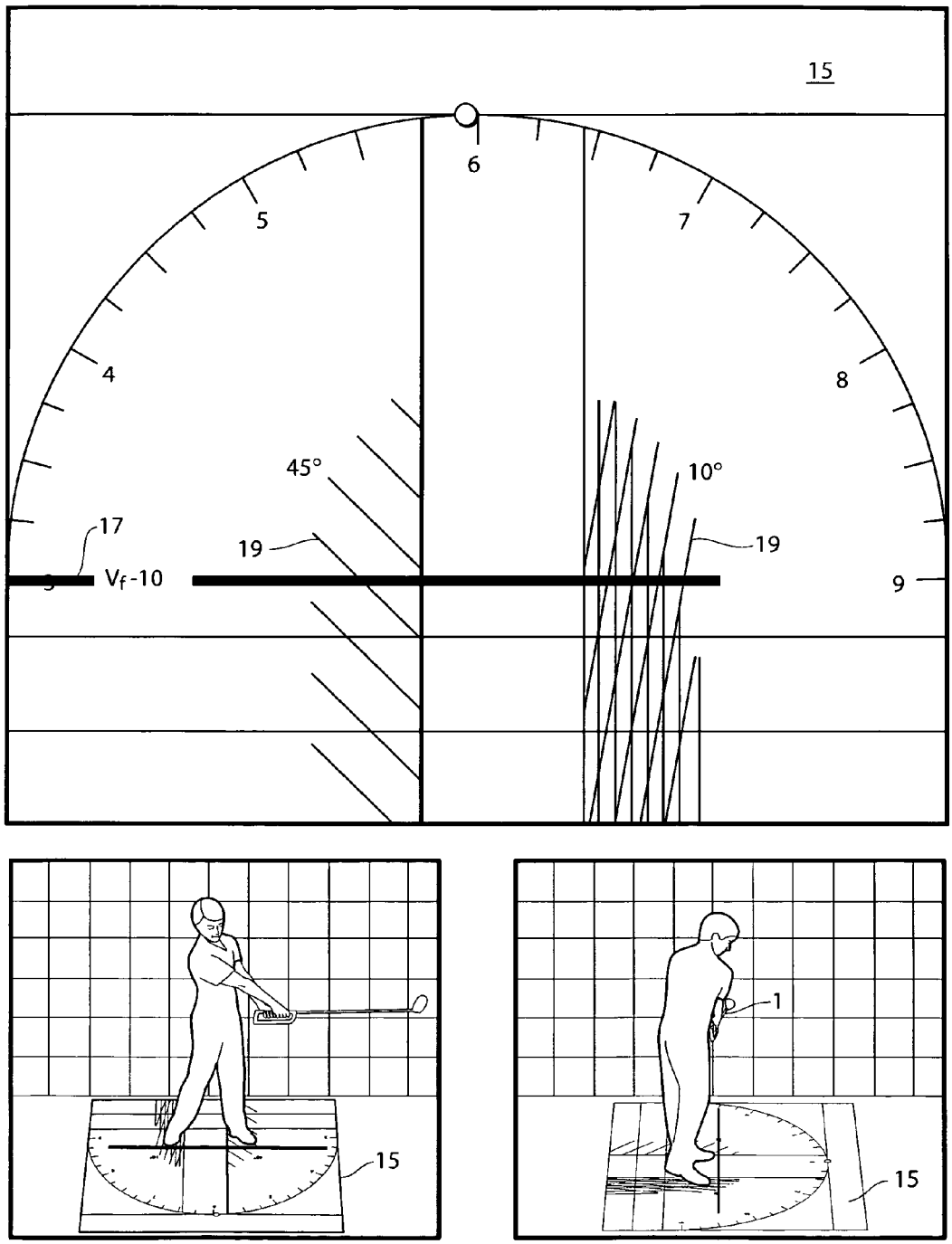
FIG. 11 is a top view showing a mat of the present invention including a tenth mat line, as well as two smaller front and left side views illustrating an individual using the golf swing training system of the present invention with the individual's golf swing in a tenth position.

With reference to FIG. 11, the golfer continues his follow-through until he reaches a "toe up" position. The tenth mat line 17 is added to the mat 15 as follows.

The golfer continues his golf swing follow-through until the light line 13 is approximately parallel to his feet and the light line strikes the mat's 3:00 position.

Using the marking materials, a mat line 17 is added to the mat to reflect the light line's position and orientation.

Eleventh Mat Line

Figure 12:
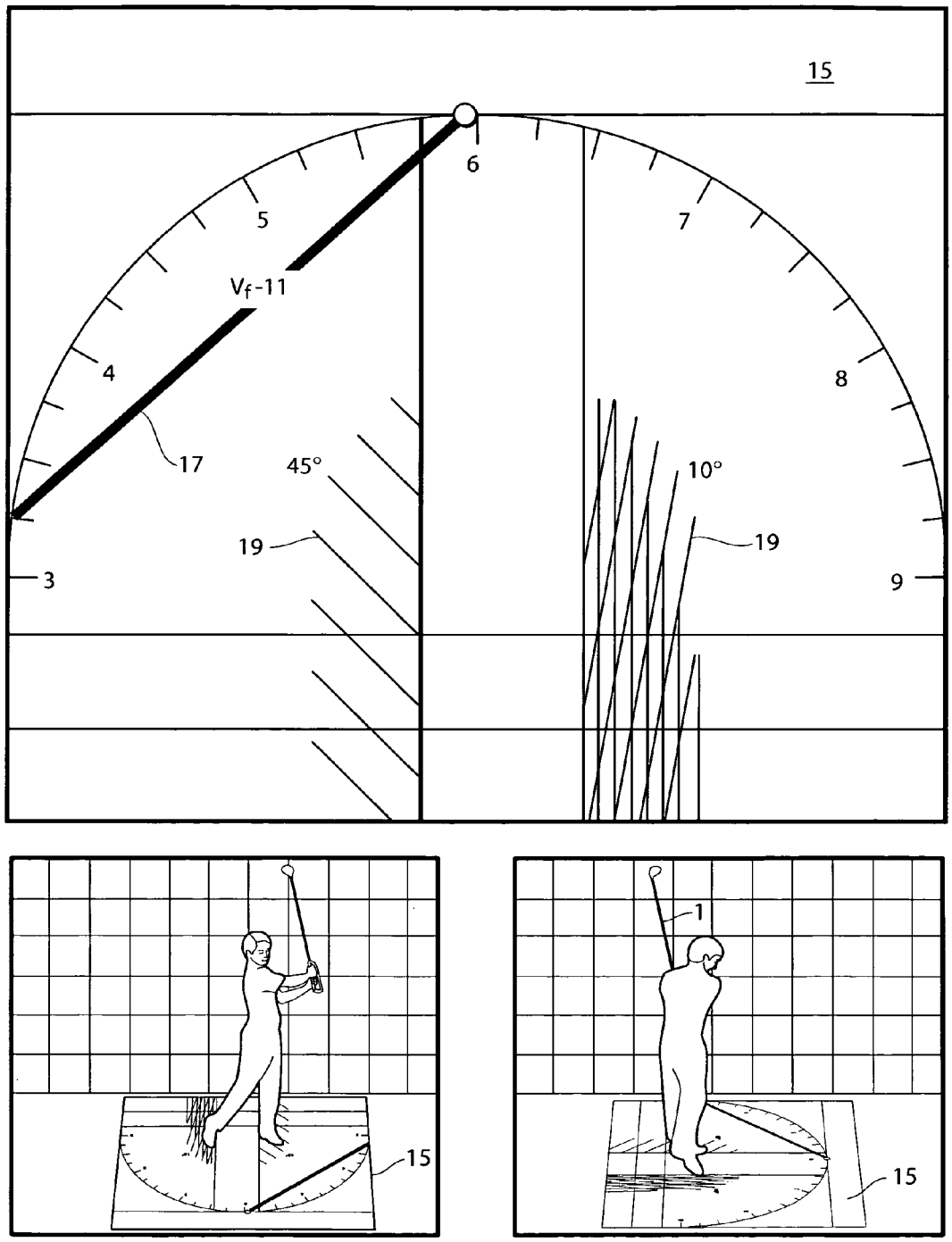
FIG. 12 is a top view showing a mat of the present invention including an eleventh mat line, as well as two smaller front and left side views illustrating an individual using the golf swing training system of the present invention with the individual's golf swing in an eleventh position.

With reference to FIG. 12, the final mat line 17 is added to the mat 15 in accordance with the following steps.

The golfer rotates his body to a fully rotated and standing position. This will result in nearly all of his weight on the golfer's left heel.

The light line 13 will pass through a position approximately 3:45 on the mat's clock dial. Once the light line is in place, the final eleventh mat line is added to the mat using the marking materials.

Completed and Use of Practice Mat

Figure 13:
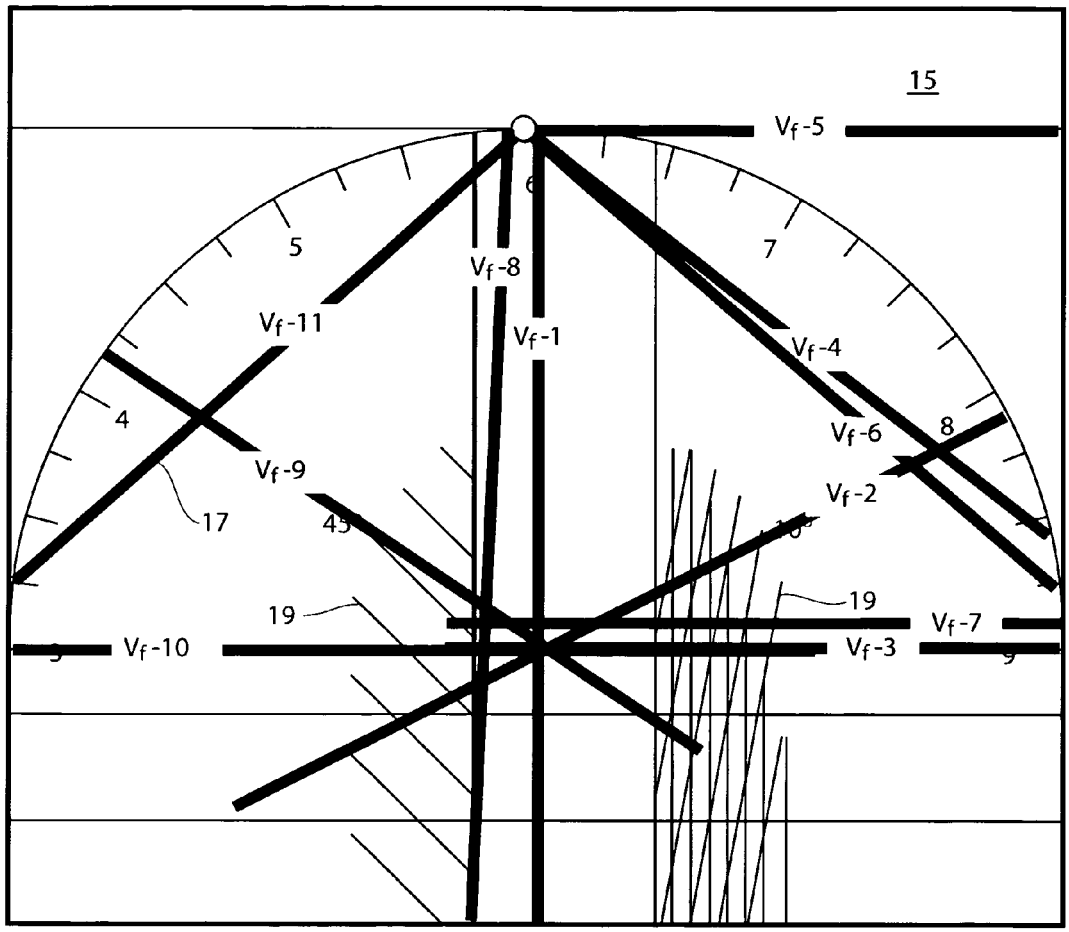
FIG. 13 is a preferred practice mat of the present invention including an eleven (11) mat line template.

As reflected in FIG. 13, the practice mat includes feet lines 19 as well as eleven mat lines 17. By continuously practicing his golf swing, the golfer erases undesired muscle memory reflecting a bad swing, and ingrains replacement muscle memory reflecting a good swing. Using the golf swing training system of the present invention, a golfer may develop numerous drills to train their golf swing. Each of these drills will typically include practicing his golf swing by placing his feet on the practice mat 15 as described above and rotating through a practice swing. Upon his body rotating so that the light line 13 engages and aligns to a mat line, the golfer holds his position for several seconds before rotating to the next position. This procedure is repeated through the golf swing so that the golfer maintains his position for one or more seconds as the light line engages the mat lines shown in FIGS. 2-13. By repeating this drill, and other similar drills, the golfer develops a consistent and improved golf swing.

Having described my invention in such terms as to enable those skilled in the art to understand and practice it, and having defined and identified the presently preferred embodiments thereof, I claim:

1. A swing training system comprising:

a club including a head and a shaft;

a light source attached to the club shaft producing a plane of light, the plane of light forming a visible line of light when striking a flat surface; and a mat including a position for a golfer to stand upon and a plurality of substantially straight non-parallel mat lines which;

said mat lines positioned upon said mat so that upon swinging said club in a golf swing motion, the light source forms a moving light plane which, in turn, forms a line of light which moves and rotates upon said mat, said line of light appearing to align and appear upon a plurality of said non-parallel mat lines during a single golf swing in the event that the golf swing is proper.

2. A method of assisting a golfer to improve his swing by providing and using a swing aid comprising the steps of:

providing a swing training system including a club including a head and a shaft, a light source attached to the club shaft producing a plane of light which forms a visible line of light when striking a flat surface, and a mat including a position for a golfer to stand upon and a plurality of substantially straight non-parallel mat lines which, the mat lines positioned upon the mat so that upon swinging the club in a golf swing motion, the light source forms a moving light plane which, in turn, forms a line of light which moves and rotates upon the mat, the line of light appearing to align and appear upon a plurality of the mat lines during a golf swing in the event that the golf swing is proper;

positioning a person upon the mat with the club in the person's hands; and swinging the club once so that the light source forms a moving light plane which in turn, forms a line of light which moves upon the mat; and aligning and producing upon a plurality of the non-parallel mat lines the line of light during the single golf swing in the event that the golf swing is proper.

* * * * *